US008113167B2

(12) United States Patent
Jessberger et al.

(10) Patent No.: US 8,113,167 B2
(45) Date of Patent: Feb. 14, 2012

(54) OIL PAN

(75) Inventors: Thomas Jessberger, Asperg (DE); Roman Eder, Ludwigsburg (DE)

(73) Assignee: Mann + Hummel GmbH, Ludwigsburg (DE)

( * ) Notice: Subject to any disclaimer, the term of this patent is extended or adjusted under 35 U.S.C. 154(b) by 0 days.

(21) Appl. No.: 12/712,619

(22) Filed: Feb. 25, 2010

(65) Prior Publication Data

US 2010/0212623 A1 Aug. 26, 2010

Related U.S. Application Data

(63) Continuation of application No. PCT/EP2008/060334, filed on Aug. 6, 2008.

(30) Foreign Application Priority Data

Aug. 27, 2007 (DE) ..... 10 2007 040 665

(51) Int. Cl.
*F01M 1/02* (2006.01)

(52) U.S. Cl. ..... 123/196 R

(58) Field of Classification Search ..... 123/195 C, 123/195 A, 196 R, 198 E, 90.38, 195 R; 440/88 L, 440/88 C; 220/327; 184/1.5, 6.22; *F01M 1/02*
See application file for complete search history.

(56) References Cited

U.S. PATENT DOCUMENTS

| | | | | |
|---|---|---|---|---|
| 5,934,241 | A * | 8/1999 | Von Esebeck et al. | 123/196 R |
| 6,131,543 | A * | 10/2000 | Achenbach et al. | 123/195 C |
| 6,584,950 | B1 * | 7/2003 | Cunningham | 123/195 C |
| 6,796,283 | B1 | 9/2004 | Fleury | |
| 2003/0029412 | A1 | 2/2003 | Kato | |
| 2004/0084250 | A1 | 5/2004 | Morii | |

FOREIGN PATENT DOCUMENTS

| | | |
|---|---|---|
| DE | 19735445 | 1/1999 |
| DE | 19955636 | 5/2001 |
| DE | 102004036286 | 3/2005 |
| DE | 102005004287 | 8/2006 |
| DE | 102006014854 | 10/2006 |
| JP | 2002153712 | 5/2002 |

OTHER PUBLICATIONS

PCT search of PCT/EP2008/060334; DE patent office search of DE 10 2007 040 665.9.

* cited by examiner

*Primary Examiner* — Michael Cuff
*Assistant Examiner* — Keith Coleman
(74) *Attorney, Agent, or Firm* — James Hasselbeck

(57) ABSTRACT

An oil pan of plastic material is provided with an oil suction pipe and an oil screen that is formed as one piece together with the oil suction pipe, wherein the oil suction pipe is comprised of two plastic shells and the oil screen that covers an inlet opening of the oil suction pipe is formed as one piece together with one plastic shell and extends down to the pan bottom.

17 Claims, 5 Drawing Sheets

OIL PAN

CROSS REFERENCE TO RELATED APPLICATIONS

This application is a bypass continuation of international patent application PCT/EP2008/060334, filed Aug. 6, 2008, the contents of which are incorporated herein by reference in its entirety. Priority is claimed based on Federal Republic of Germany patent application no. 10 2007 040 665.9 filed Aug. 27, 2007.

TECHNICAL FIELD

This disclosure relates to an oil pan for an internal combustion engine and, more particularly, to an oil pan of plastic material including an oil suction pipe and an oil screen that are formed as one piece.

BACKGROUND OF THE INVENTION

Such oil pans are usually comprised of plastic material and comprise an oil suction pipe for draining the oil contained in the oil pan wherein the inlet opening of the suction pipe is covered by an oil screen by means of which dirt particles are filtered out.

DE 10 2006 014 854 A1 discloses an oil pan for an internal combustion engine that has a pan body with a cylindrically embodied section arranged within an area of the inwardly positioned pan bottom; on the cylindrically embodied section a cover member with integrated oil pipe can be attached. In the cover member an opening facing upwardly is provided that is positioned so as to be spaced from the pan bottom and has the function of an inlet opening for the oil to be sucked out wherein the inlet opening is covered by a screen that forms a filter element. According to one embodiment variant disclosed in DE 10 2006 014 854 A1, the cover member and the screen can be embodied as a conjoint composite body that is comprised of plastic resin.

From the prior it can be seen that the inlet opening is covered by the oil screen positioned above the pan bottom, therefore a complete removal of the oil and emptying of the oil pan is not possible. There remains a need in the art for an oil pan configured to overcome these limitations in the prior art.

SUMMARY OF THE INVENTION

It is an object of the present invention to provide an oil pan configured with simple technical measures that ensure an efficient removal of oil. This object is solved according to the invention with the features of claim 1. The dependent claims provide expedient further embodiments.

In one aspect of the invention, an oil pan is comprised of plastic material and has in addition to the pan body an oil suction pipe as well as an oil screen wherein the oil suction pipe and the oil screen as well as the pan body are manufactured of plastic material. The oil suction pipe is of a two-part configuration and is comprised of two plastic shells, wherein the oil screen is formed as one piece together with one of the plastic shells. The oil screen covers an inlet opening in the oil suction pipe, through which the oil is drained from the oil pan, and extends down to the bottom of the oil pan.

In this embodiment it is ensured that the oil can be drained completely from the oil pan. The oil screen that covers the inlet opening of the oil suction pipe extends down to the pan bottom; accordingly, the inlet opening is also positioned on or adjacent to the oil pan bottom and is thus located on or adjacent to the lowermost point of the pan bottom.

As a result of the one-piece embodiment of the oil suction pipe and the oil screen, a significant simplification for manufacture and assembly is achieved. The entire oil pan is preferably produced by injection molding of plastic material, wherein the configuration of the oil suction pipe of two separate plastic shells makes it possible to produce first one of the plastic shells together with the oil screen and, subsequently, to place it in a simple mounting process onto the second plastic shell and to connect it therewith, wherein the second plastic shell is preferably embodied as one piece together with the oil pan body of the oil pan.

This method can be realized especially well when the oil screen is embodied as one piece together with the plastic top shell of the oil suction pipe. In addition, it is also possible to configure the oil screen as one piece together with the plastic bottom shell of the oil suction pipe that is preferably fixedly integrated into the oil pan body.

The connection between plastic bottom shell and plastic top shell of the oil suction pipe is preferably realized by way of welding, for example, friction welding or vibration welding or ultrasound welding. The two-part configuration of the oil suction pipe provides significant advantages regarding the manufacture wherein by welding a flow-tight connection between the bottom shell and top shell of the oil suction pipe is achieved.

The oil screen may be positioned relative to the bottom plane at an angle that is within an angle range up to 90 degrees and preferably within an angle range of 0 degrees up to approximately 30 degrees. The slanted position enables the configuration of the inlet opening at the end face of the oil suction pipe above the pan bottom, wherein the inlet opening extends down to the pan bottom so that the oil located thereat can be drained completely.

The integration of the oil screen into one of the plastic shells of the oil suction pipe can be realized in various ways. For example, the oil screen is formed integrally on the wall of a plastic shell in such a way that the oil screen projects past the wall of the plastic shell. In the case of integration into the plastic top shell, the oil screen in this embodiment projects preferably past the end face of the plastic top shell and covers the inlet opening that is preferably mainly located within the plastic bottom shell. However, it is also envisioned to integrate the oil screen completely or at least partially into the wall of the plastic shell wherein in this embodiment the oil screen covers a cutout in the wall or the screen holes of the oil screen together form the inlet opening in the wall of the plastic shell.

The oil suction pipe can be straight, curved, or can be of a stepped configuration. Preferably, the oil suction pipe extends between the inlet opening and a further mouth, by means of which the oil suction pipe is connected to a drainage passage, in a slanted orientation relative to the pan bottom.

The above features and advantages and other features and advantages of the present invention are readily apparent from the following detailed description of the best modes for carrying out the invention when taken in connection with the accompanying drawings.

BRIEF DESCRIPTION OF THE DRAWINGS

The accompanying Figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Features of the present invention, which are believed to be novel, are set forth in the drawings and more particularly in the appended claims. The invention, together with the further objects and advantages thereof, may be best understood with reference to the following description, taken in conjunction with the accompanying drawings. The drawings show a form of the invention that is presently preferred; however, the invention is not limited to the precise arrangement shown in the drawings.

Figure 1:
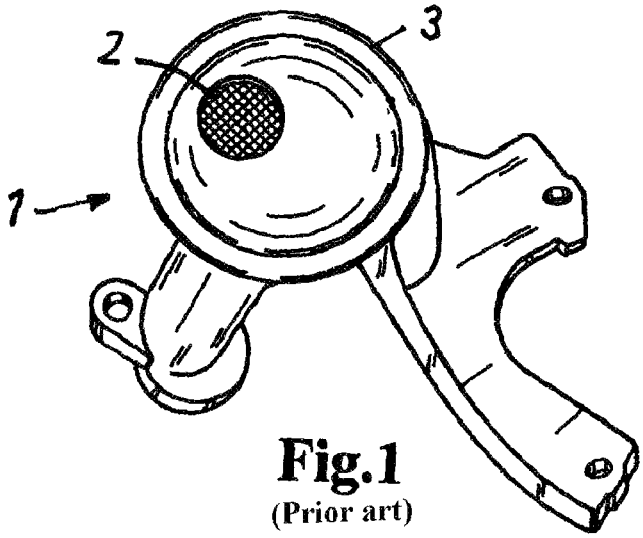
Fig.1 (Prior art)
FIGS. 1 through 4 show the prior art with a separately embodied oil screen that is connected with an oil suction pipe wherein the oil suction pipe is part of an oil pan.

In the Figures same components are identified with the same reference numerals Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related an oil pan for an internal combustion engine and, more particularly, to an oil pan of plastic material including an oil suction pipe and an oil screen that are formed as one piece as disclosed herein. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

In FIGS. 1 through 4, an example embodiment of the prior art is illustrated in which the oil screen 2 is embodied separate from the oil suction pipe 1 and by suitable connecting means is connected with the wall of the oil suction pipe. In FIG. 1 an oil suction pipe 1 is illustrated. It is usually screw-connected to the oil pump and has a small distal spacing relative to the oil pan. At the mouth of the oil suction pipe 1 there is an oil screen 2 that is embodied as a separate component and, by means of a lid 3 positioned, thereon, is attached to the oil suction pipe 1.

Figure 2:
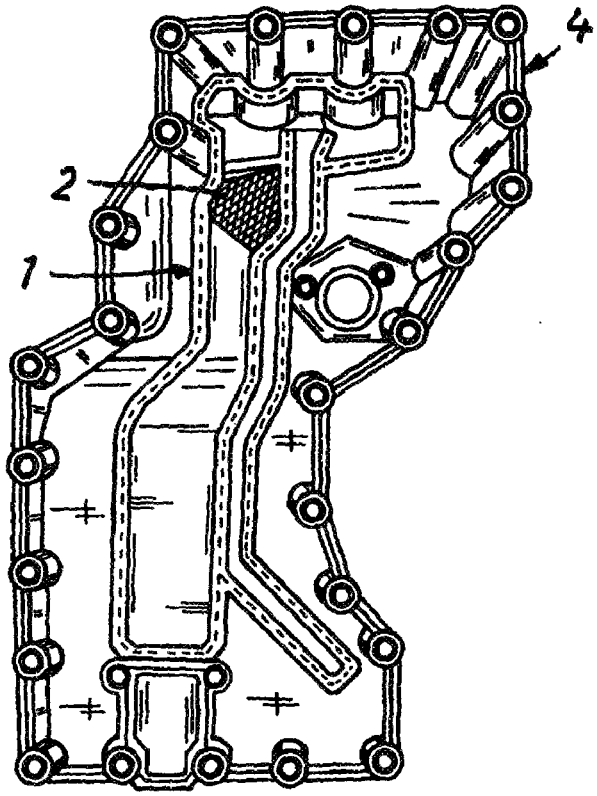
Fig.2 (Prior art)

In FIG. 2, an example embodiment of the prior art is shown. The oil pan 4 is shown in plan view. The contour of the oil suction pipe 1 is shown wherein at the inlet opening the separately embodied oil screen 2 is arranged, the oil screen 2 is inserted into the oil suction pipe contour in the oil pan.

Figure 3:
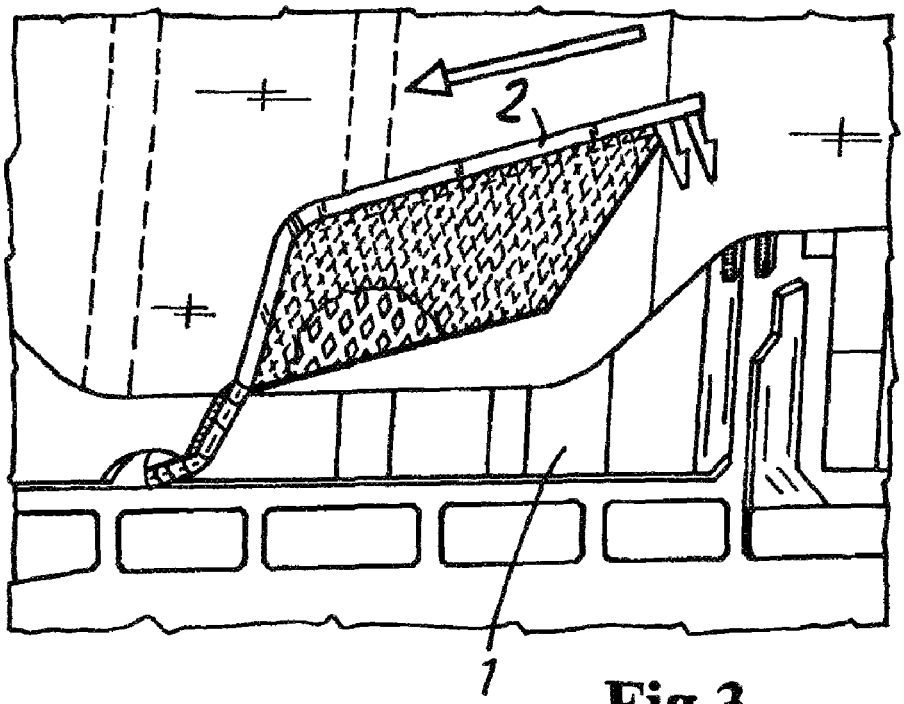
Fig.3 (Prior art)
Figure 4:
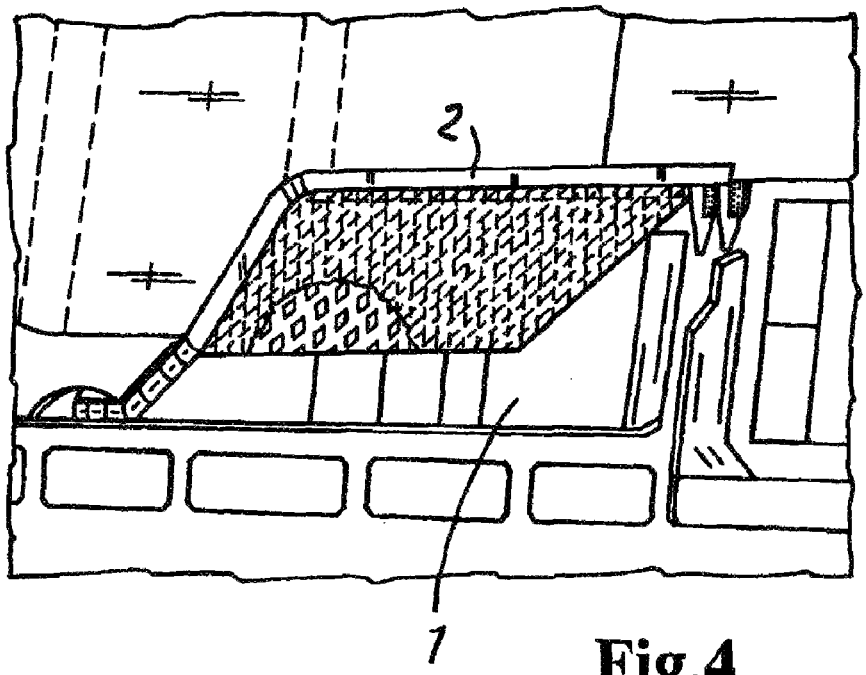
Fig.4 (Prior art)

FIGS. 3 and 4 illustrate an example embodiment of the prior art showing the separately embodied oil screen 2 is pre-mounted by means of mechanical connecting devices onto the oil suction pipe 1. In the illustrated prior art embodiment, a clip connection (shown at the right portion of the screen) is provided for this purpose. After pre-mounting, the oil screen may be connected, for example, by way of vibration welding, to the oil suction pipe in a fluid-tight way.

Figure 5:
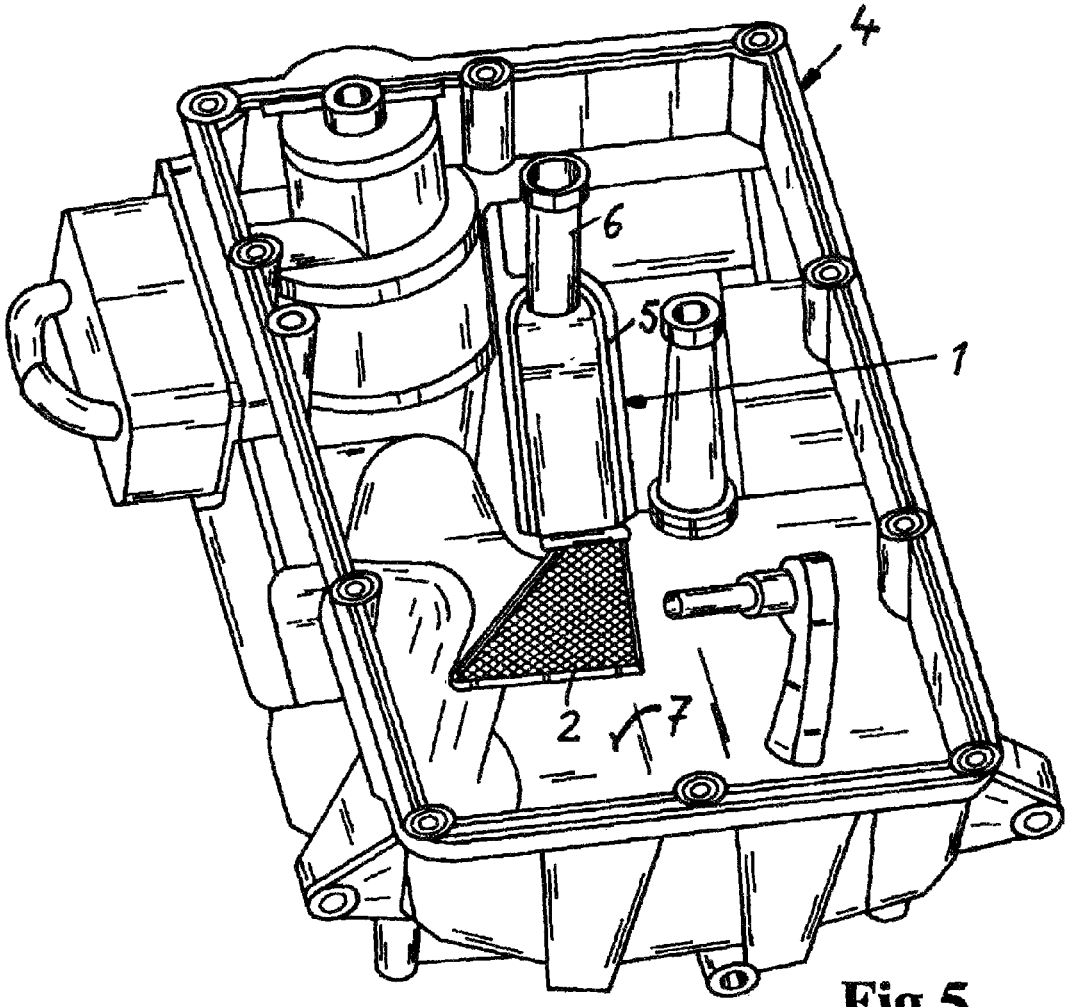
FIG. 5 is a perspective view of an oil pan according to the invention with an oil screen that is embodied integrally with the plastic top shell of an oil suction pipe, consistent with at least one aspect of the present invention.
Figure 6:
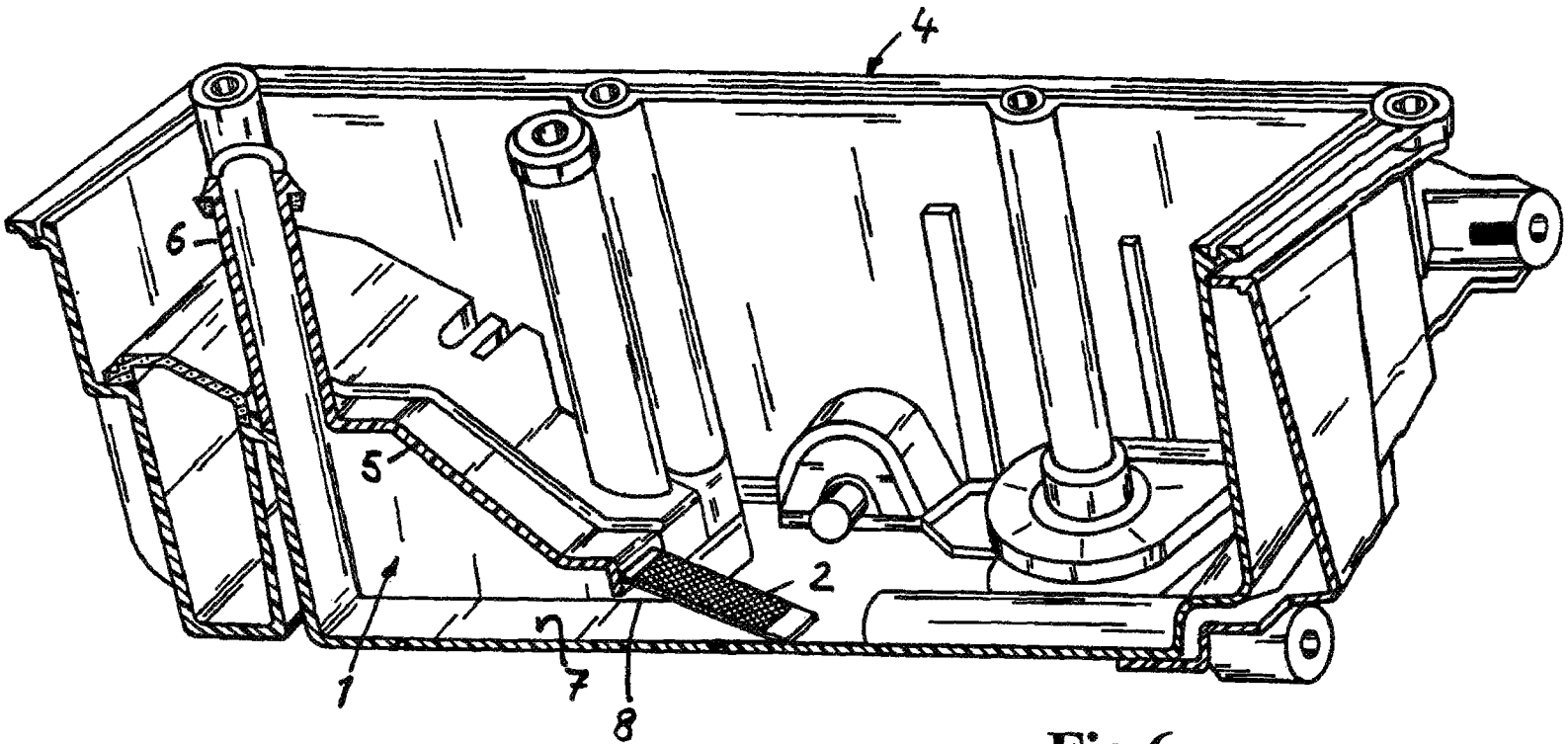
FIG. 6 is a sectional view of the oil pan with oil suction pipe and oil screen integrated therein, consistent with at least one aspect of the present invention.
Figure 7:
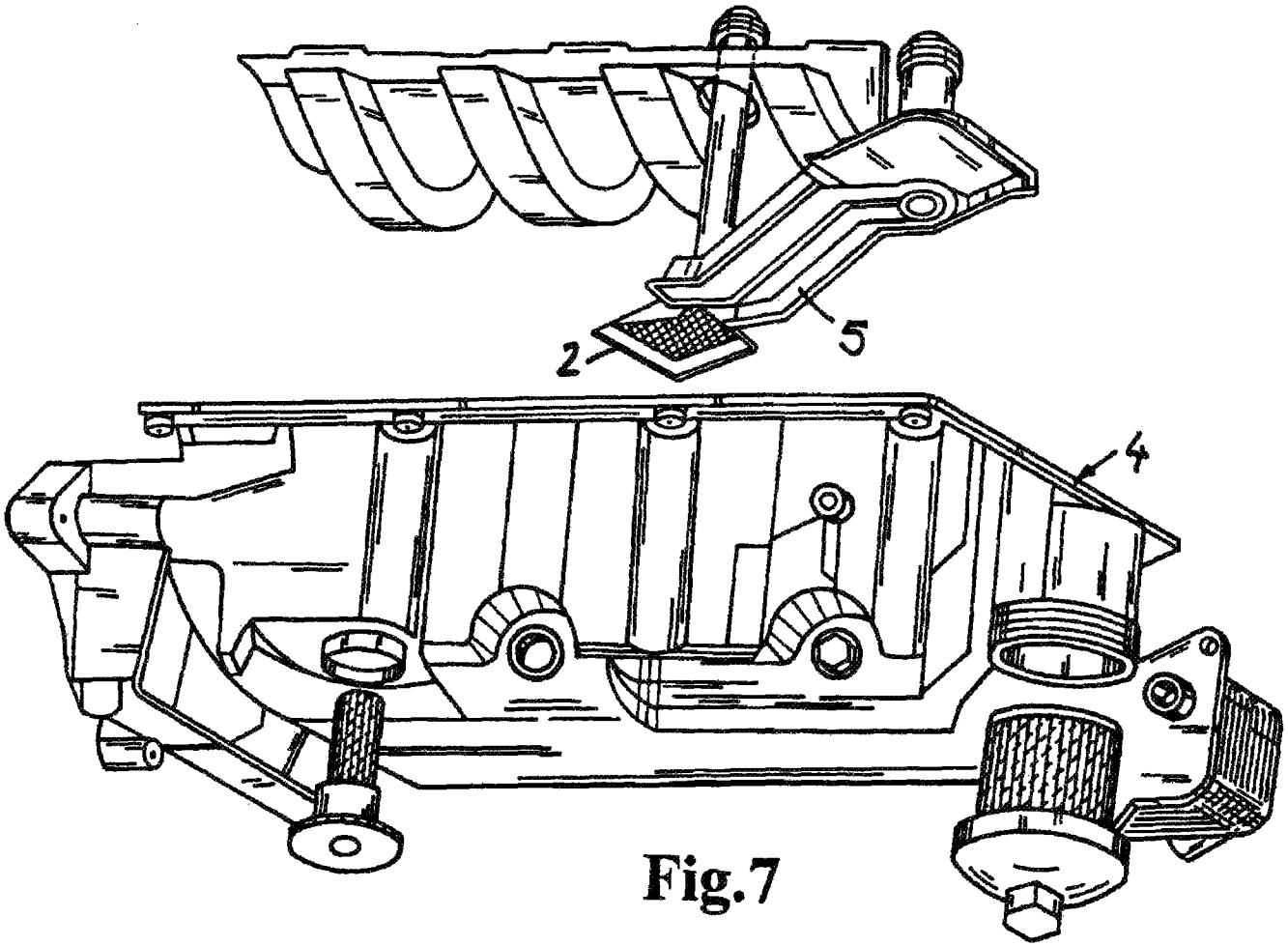
FIG. 7 depicts a perspective illustration of the oil pan as well as of the separately embodied plastic top shell of the oil suction pipe with integrated oil screen, consistent with at least one aspect of the present invention.

In FIGS. 5 to 7 one exemplary embodiment according to at least one aspect of the present invention is illustrated. As shown in FIG. 5, the oil suction pipe 1 comprises a plastic top shell 5 that is placed onto a correlated plastic bottom shell of the oil suction pipe 1. The plastic top shell 5 is embodied as a separate plastic component while the plastic bottom shell is formed as one piece together with the pan body of the oil pan 4.

The oil screen 2 together with the plastic top shell 5 are embodied as one piece and extend in the mounted position down to the pan bottom 7 of the oil pan. The oil screen 2 covers an inlet opening that is formed at the end face of the oil suction pipe 1 and extends accordingly also to the pan bottom 7. In this way, it is possible to completely remove oil that is located within the oil pan.

On the end that is opposite the inlet opening that is covered by the oil screen 2, the oil suction pipe 1 opens into a plastic drainage passage 6 through which the oil is drained from the oil pan.

The oil screen 2 is comprised of the same material as the oil suction pipe 1 and is produced in particular by an injection molding process from plastic material. The oil screen 2 extends across the end face of the plastic top shell 5 and projects past the end face. In the embodiment the oil screen 2 has an approximately trapezoidal cross-sectional configuration wherein the wider side of the oil screen rests immediately on the pan bottom 7 and the narrow side is connected to the end face of the plastic top shell 5. The oil screen 2 has a plurality of perforation-like through openings that together form the inlet opening for the oil for drainage from the oil pan.

As illustrated in the perspective section view according to FIG. 6, the plane of the oil screen 2 is positioned relative to the plane of the pan bottom 7 at a relatively flat angle of maximally 30 degrees. Moreover, FIG. 6 shows that the drainage passage is formed as one piece together with the plastic top shell 5 that is placed onto the plastic bottom shell 8 and is connected therewith by welding, in particular vibration welding. The plastic bottom shell 8 is formed as one piece together with the oil pan body.

FIG. 7 shows that the plastic top shell 5 including the oil screen 2 formed as one piece therewith is embodied as a separate pre-manufactured component that, in the mounting process, is inserted into the oil pan 4 and is connected by friction welding or a similar procedure to the plastic bottom shell at an appropriate location. The oil screen 2 is formed integrally on the end face of the plastic top shell 5 and projects thus past the end wall of the plastic top shell.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The invention claimed is:

1. Oil pan of plastic material having an oil pan body, said oil pan comprising:

an oil suction pipe including a bottom shell formed as a one-piece unitary component of the oil pan body, said bottom shell arranged on a pan bottom wall of said oil pan body;

a top shell secured to said bottom shell and closing over said bottom shell in a flow tight connection forming an oil suction pipe having an oil flow passage therein;

an oil screen is a one-piece unitary component of either said top or bottom shells;

an elongated upwardly extending oil drainage pipe having an oil drainage passage therein, said oil drainage pipe unitary one-piece with said top shell, a first end of said oil drainage pipe affixed to and in flow communication with said oil suction pipe, said oil drainage pipe extending upwards away from said oil pan bottom to an opposing second oil drainage pipe end arranged at an open top portion of said oil pan;

wherein said oil screen forms a filter element operative to filter oil before it enters an oil inlet end of said oil suction pipe;

wherein said oil screen is secured along circumferential edges to said pan bottom wall;

wherein said oil suction pipe is comprised of two plastic shells defining a conduit for oil flow;

wherein said oil screen extends over and covers said inlet opening of said oil suction pipe such that oil entering said suction pipe must flow through said oil screen;

wherein said oil suction pipe extends down to said pan bottom of said oil pan with said oil screen positioned at an end of said suction pipe nearest said pan bottom.

2. The oil pan according to claim 1, wherein wherein said oil screen and said plastic top shell are a one piece unitary component.

3. The oil pan according to claim 1, wherein wherein said oil screen and said plastic bottom shell are a one piece unitary component.

4. The oil pan according to claim 2, wherein said plastic top shell of said oil suction pipe is embodied as a separate component and is weldably secured to said plastic bottom shell by any of: friction welding or vibration welding.

5. The oil pan according to claim 1, wherein said plastic bottom shell of said oil suction pipe is a one piece component with said oil pan body.

6. The oil pan according to claim 1, wherein said oil screen is integral with a wall of one of said two plastic shells of said oil suction pipe.

7. The oil pan according to claim 6, wherein said top shell has an oil screen secured to and projecting outwardly away from an oil inlet end of said top shell of said oil suction pipe;

wherein said oil screen and top shell are formed as one-piece unitary component of the same material.

8. The oil pan according to claim 7, wherein said inlet opening of said oil suction pipe is arranged at said pan bottom or immediately adjacent to said pan bottom.

9. The oil pan according to claim 8, wherein said oil suction pipe extends between said inlet opening and a mouth arranged on an opposing end of said oil suction pipe, said mouth configured in oil flow communication with a drainage passage arranged to deliver oil to an oil pump, said oil suction pipe arranged at a slant relative to said pan bottom.

10. The oil pan according to claim 9, wherein at least one wall of one of said two shells of said oil suction pipe is of a stepped configuration.

11. The oil pan according to claim 10, wherein one of said two plastic shells is a plastic top shell; and wherein said wall having said stepped configuration is formed on said top shell.

12. Oil pan of plastic material having an oil pan body, said oil pan comprising:

circumferential side walls secured to a pan bottom wall forming said oil pan body;

an oil suction pipe including;

a bottom shell formed as a one-piece unitary component of said oil pan body, said bottom shell arranged on said pan bottom wall of said oil pan body;

a top shell secured to said bottom shell and closing over said bottom shell in a flow tight connection, said closed over shells defining an oil suction pipe therein having a conduit for oil flow therein, said top shell having an oil screen secured to and projecting outwardly from an oil inlet end of said top shell, said oil screen and top shell formed as one-piece unitary component of the same material;

an elongated upwardly extending oil drainage pipe having an oil drainage passage therein, said oil drainage pipe unitary one-piece with said top shell, a first end of said oil drainage pipe affixed to and in flow communication with said oil suction pipe, said oil drainage pipe extending upwardly away from said oil pan bottom to an opposing second oil drainage pipe end arranged at an open top portion of said oil pan;

wherein said oil screen forms a filter element operative to filter oil before it enters said oil suction pipe from said oil pan;

wherein said oil screen is secured along circumferential edges to said pan bottom wall;

wherein said oil screen extends over and covers said inlet opening of said oil suction pipe such that oil entering said suction pipe must flow through said oil screen;

wherein said oil suction pipe extends down to a pan bottom of said oil pan with said oil screen positioned at an end of said suction pipe nearest said pan bottom.

13. The oil pan according to claim 12, wherein said oil screen is positioned at said bottom pan wall and slanted at an angle between 0 to 30 degrees relative to said pan bottom wall.

14. The oil pan according to claim 1, wherein entire length of said oil suction pipe lies between said top and bottom shells.

15. The oil pan according to claim 12, wherein entire length of said oil suction pipe lies between said top and bottom shells.

16. The oil pan according to claim 1, wherein said oil entering said oil inlet end of said oil suction pipe and exits said second end of said oil drainage pipe without flowing through oil pumps or oil filters.

17. The oil pan according to claim 12, wherein said oil entering said oil inlet end of said oil suction pipe and exits said second end of said oil drainage pipe without flowing through an oil pump or oil filter.

* * * * *